US005800110A

United States Patent [19]

Georgitsis et al.

[11] Patent Number: 5,800,110

[45] Date of Patent: Sep. 1, 1998

[54] BOOK CASE JOINT FORMING METHOD AND APPARATUS

[75] Inventors: Nikolaos Georgitsis, Lubbecke; Kurt Begemann, Lohne, both of Germany

[73] Assignee: Kolbus GmbH & Co. KG, Rahden, Germany

[21] Appl. No.: 905,914

[22] Filed: Aug. 4, 1997

Related U.S. Application Data

[63] Continuation of Ser. No. 437,181, May 8, 1995, abandoned.

[30] Foreign Application Priority Data

May 9, 1994 [DE] Germany ..... 44 16 358.4

[51] Int. Cl.[6] ..... B42C 7/00

[52] U.S. Cl. ..... 412/3; 412/4; 412/1; 412/17

[58] Field of Search ..... 412/1, 4, 5, 8, 412/18, 21, 902, 17, 3

[56] References Cited

U.S. PATENT DOCUMENTS

| | | | |
|---|---|---|---|
| 3,771,185 | 11/1973 | Thorp et al. . | |
| 4,074,382 | 2/1978 | Palme et al. | 412/22 |
| 4,150,453 | 4/1979 | Vaughn | 412/22 |
| 5,160,234 | 11/1992 | Lazar | 412/902 |

FOREIGN PATENT DOCUMENTS

| | | |
|---|---|---|
| 37 33 435 A1 | 10/1987 | Germany . |
| 39 05 767 A1 | 2/1989 | Germany . |

*Primary Examiner*—Willmon Fridie, Jr.
*Attorney, Agent, or Firm*—Alix, Yale & Ristas, LLP

[57] ABSTRACT

Hinge joints are impressed in a book cover through the use of a heated tool, having the profile of the desired joint, and the joint is thereafter immediately stabilized. Joint stabilization is accomplished by rapid reduction of the temperature of the joint areas while maintaining the application of compressive force.

19 Claims, 2 Drawing Sheets

BOOK CASE JOINT FORMING METHOD AND APPARATUS

This continuation of application Ser. No. 08/437,181 filed on May 8, 1995 , abandoned.

BACKGROUND OF THE INVENTION

1. Field of the Invention

The present invention relates to the formation of book case joints and, particularly, to an improvement in the technique for producing book cover "hinges" which includes the step of heating the joint areas while applying compressive force to thereby shape the joint.

More specifically, this invention is directed to improvements in apparatus for heat-forming book case joints and, especially, to apparatus which performs a stabilization operation immediately subsequent to the heat assisted formation of the joints. Accordingly, the general objects of the present invention are to provide novel and improved methods and apparatus of such character.

2. Description of the Prior Art

In the commercial manufacture of a "hard" cover book, the final production steps include pressing the book while the casing hinge joints are formed adjacent the book spine. These steps are performed on a multi-station bincling-in and pressing machine immediately subsequent to the "casing-in step". In the casing-in step the book block is fitted into the cover, the cover being formed by front and back "case boards" and a spine strip, the case boards and spine strip being adhered to a "case covering". The formation of the casing joints results in the book having an aesthetically pleasing shape and, most importantly, is essential to a high quality product, i.e., a product that is both durable and well designed for its intended use.

In the prior art binding-in and pressing machines, the book is subjected to pressure over substantially its entire face areas while the hinge joints are formed. The hinge joints are produced through the action of a heated profiled tool. This heated tool applies compressive force to the case covering material in the two oppositely disposed regions located between the spine strip and the case boards. These heated, profiled tools are commonly referred to in the art as "joint-forming rails".

The function of the joint-forming rails is to heat the case covering material thoroughly to thereby increase its ability to stretch. Additionally, the application of heat has been found to enhance the adhesive bonding of the book block to the case in the vicinity of the fold joint. Accordingly, the use of heated profiled tools is the industry standard in order to achieve book casing fold-joints that will be both durable and have an acceptable appearance. It is important that the joint-forming rails, in use, be maintained in contact with the book casing for a sufficient time to ensure even distribution and subsequent setting of the adhesive, which will typically be more thickly applied in the vicinity of the joint, in order for the casing joints. It is therefore common for the joints to be properly formed when the adhesive subsequently sets to be formed in a plurality of sequentially performed pressing steps.

SUMMARY OF THE INVENTION

The present invention constitutes an improvement over the prior art technique of heat-forming book case joints and, particularly, comprises a method for enhancing the quality of such heat-formed joints. The present invention also contemplates novel apparatus for use in the practice of this improved process.

The method of the present invention comprises the step of cooling the book case joints immediately after the heat-forming operation. It has been found that, unexpectedly, the quality of a heatformed book case joint is significantly improved by subjecting the formed joint to a low temperature, while maintaining the joint area in a compressed condition, immediately after the formation thereof with heated joint forming rails. The cooling step has an exceedingly beneficial effect on the stabilization of the shape of the formed joint.

Apparatus in accordance with the invention comprises a modified state-of-the art book binding and pressing machine which includes a cooling stage. In accordance with one embodiment of the invention, cooled joint-forming rails are provided downstream, in the direction of book movement, from the last work station at which the book case joint is shaped through the use of heated joint-forming rails. In an alternative embodiment, cooled transfer elements, which acquire the book after formation of the case joints, engage the joints after the release thereof by the joint-forming rails.

BRIEF DESCRIPTION OF THE DRAWINGS

The present invention may be better understood, and its numerous objects and advantages will become apparent to those skilled in the art, by reference to the accompanying drawings wherein like reference numerals refer to like elements in the two figures and in which.

DETAILED DESCRIPTION OF THE DISCLOSED EMBODIMENTS

As is well know, a book binding-in and pressing machine may consist of a multiplicity of pressing units which are equidistantly spaced along a transport path. A "book" 1, comprising a book block located within a book casing, will be fed to a transport path, subjected to a "forming" step and then be engaged by a first pair of mutually opposed pressing plates of the first of the serially arranged pressing units. The pressing plates, which are substantially the same as the plates 2 of FIG. 1 and which are adjustable to vary the separation therebetween, will compress the book. At the same time, a pair of oppositely disposed and heated joint-forming rails, these rails having the same general shape as the rails 3 of FIG. 1, will act on the joint area to impress the book case joints. As in the case of the pressing plates 2, the minimum separation between the joint-forming rails may be selected as a function of the book being manufactured.

Figure 1:
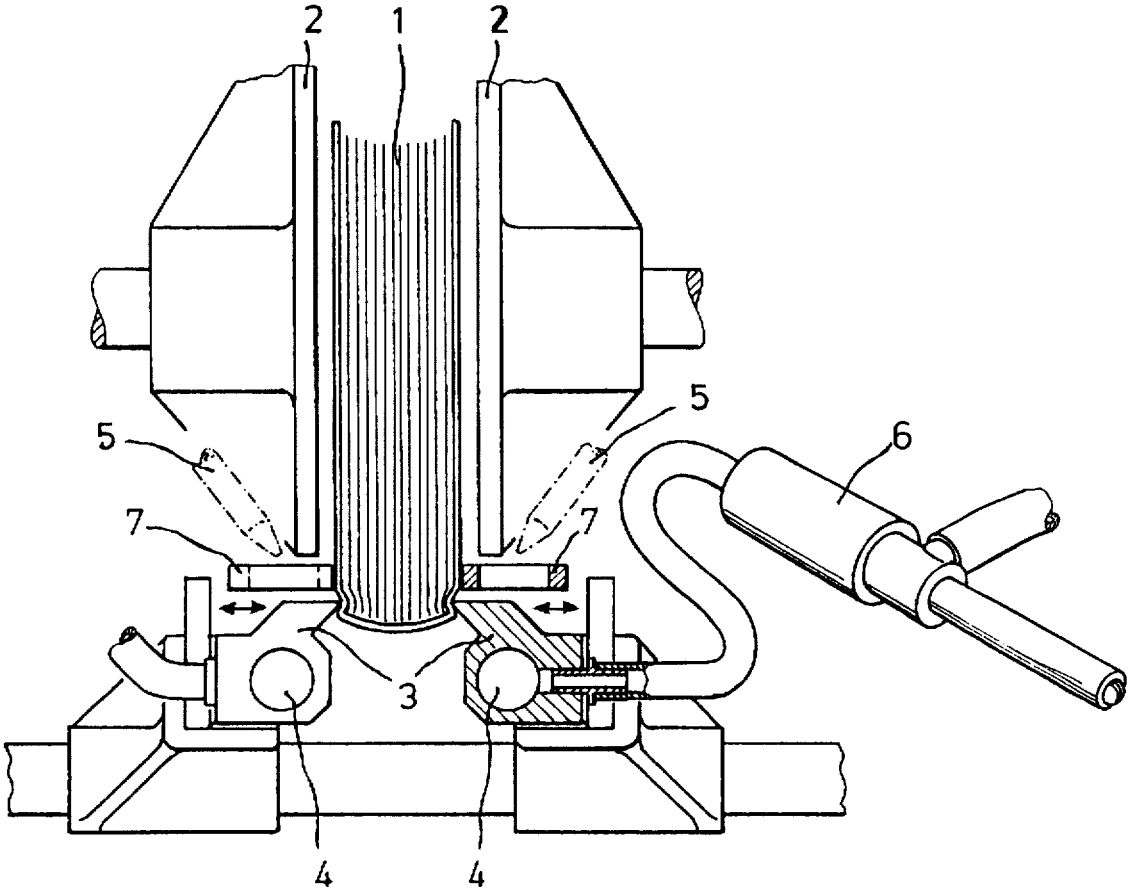
FIG. 1 is a front elevational view, partly in section, which illustrates the case joint cooling station of a modified book binding-in and pressing machine in accordance with the invention.

The heated joint-forming rails may cooperate with pressing rails, such as the rails 7 of FIG. 1, which ensure against wrinkling of the case covering material during the heat-forming operation that creates the joints.

In a typical binding-in and pressing machine, the book will be successively delivered to a plurality of pressing units with the joint-forming rails 3 serving as the transport means in the movement of the books in stepwise fashion from one pressing unit to the next. At each pressing unit, the transported book released by the previous pair of cooperating joint-forming rails will be engaged and pressed by a new pair of joint-forming rails.

In accordance with the present invention, the last pair of profiled rails, i.e., the rails 3 of FIG. 1, are cooled. Accordingly, the book case joints, in the compressed condition are cooled immediately subsequent to the heat-assisted formation thereof. The temperature to which the casing joints are subjected is preferrably below 0° C. This cooling has been found to stabilize the joints and significantly improve the quality thereof.

Continuing to discuss the FIG. 1 embodiment, the joint-forming rails 3 are equipped with cooling nozzles 6, known as "Colt" guns, which are commercially available from the Exair Company (Type 3930 vortex tubes). These cooling nozzles are connected to fluid flow passages 4 provided in the bodies of the rails 3. Accordingly, a cold fluid, which may for example be air which has been cooled to a temperature as low as –40° C. will be supplied to the passages 4. The cooling nozzles 6 may, alternatively or additionally, direct cooled gas directly onto the exterior of the joint-forming rails 3 and/or onto the adjacent pressing rails 7.

The cooling of the book case joints may also be accomplished by means of air-blast nozzles 5 which are located immediately downstream of the last pressing station, the nozzles 5 being coupled to a pressurized source of refrigerated air. The nozzles 5 will direct cold gas onto the joint-forming rails 3 and/or the pressing rails 7. The nozzles 5 may operate alone or in addition to the supply of cold gas to the passages 4 within the rails 3.

Figure 2:
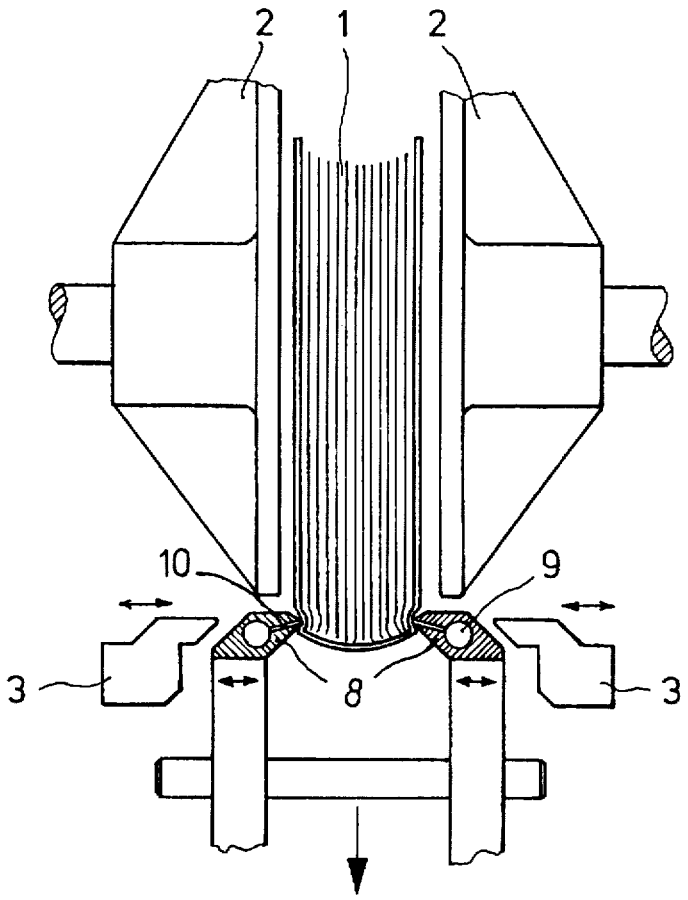
FIG. 2 is a view similar to FIG. 1 which shows a second embodiment of the invention.

The modified embodiment of the invention depicted in FIG. 2 employs, at the last pressing station, a pair of shaped transfer elements 8. The transfer elements 8 acquire the books 1 by engaging the heat-formed case joints. Upon such engagement, the transfer elements 8 function as transport means to move the book in the direction of the arrow, i.e., in the direction of the bottom of the drawing. The transfer elements 8 are, like the rails 3 of the FIG. 1 embodiment, provided with passages 9 through which a cold fluid may be caused to flow. Additionally, a discharge passage or passages 10 are provided in each transfer element 8 to permit fluid communication between the flow passages 9 and the surface of the book case joint. Accordingly, the book case joints are directly exposed to the cold gas thus enhancing the rapid cooling thereof.

As will be obvious to those skilled in the art, the transfer elements 8 can be in the form of rails, or may be rollers, belts or other like devices. Transfer elements 8 acquire the books 1 from the heated joint-forming rails 3, after retraction thereof from the book, and thereafter withdraw the book from the binding-in and pressing machine.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. In a method for the formation of the hinge joints of a book having a casing, the joints being produced by the application of heat and pressure to the sides of the book in the areas where the joints are to be formed through the use of a heated tool, the tool stretching the material comprising the book whereby the hinge joints are impressed therein, the improvement comprising the step of:

subjecting the hinge joints to cooling immediately subsequent to removal of the heated tool by causing a cooled tool to engage the impressed hinge joints.

2. The method of claim 1 wherein the step of subjecting the joint areas to cooling comprises:

directing a cooled gas to the joints.

3. The method of claim 1 wherein the step of subjecting the joint areas to cooling is performed while compressive force is applied to the joints.

4. The method of claim 1 wherein the step of subjecting the joint areas to cooling comprises:

delivering a cold fluid to a tool which, at least in part, has a shape complementary to the shape of the heat-formed joints to thereby cool the tool; and causing the cooled tool to engage the joints.

5. The method of claim 4 wherein said tool is part of a transport mechanism and the joint areas are cooled while the book is being transported.

6. The method of claim 1 wherein the step of subjecting the joint areas to cooling comprises establishing intimate contact between the joint areas and a medium which is maintained at a temperature of less than 0° C.

7. The method of claim 6 wherein the temperature of the medium which is brought into contact with the joint areas is between 0° C. and –40° C.

8. The method of claim 3 wherein the step of subjecting the joint areas to cooling comprises:

delivering a cold fluid to a tool which, at least in part, has a shape complementary to the shape of the heat-formed joints to thereby cool the tool; and causing the cooled tool to engage the joints.

9. The method of claim 8 wherein the step of subjecting the joint areas to cooling comprises establishing intimate contact between the joint areas and a medium which is maintained at a temperature of less than 0° C.

10. The method of claim 5 wherein the step of subjecting the joints to cooling comprises establishing intimate contact between the book joints and a medium which is maintained at a temperature of less than 0° C.

11. In apparatus for forming hinge joints in cased books, the joint forming apparatus including means for compressing the book by application of pressure to the opposed covers thereof while simultaneously impressing the joints into the casing with a pair of oppositely acting heated joint-forming rails, the improvement comprising:

means for acquiring the book subsequent to the impressing of the joints by the heated joint-forming rails; and a cooled tool for engaging the formed joints and subjecting the joints to a temperature below the ambient temperature while simultaneously applying a compressive force thereto.

12. The apparatus of claim 11 wherein said means for subjecting the formed joints to a temperature below ambient temperature comprises a pair of transfer elements which engage the book joints and impart movement to the book, cooling of the joints occurring simultaneously with the movent of the book.

13. The apparatus of claim 11 wherein said means for subjecting the formed book joints to a temperature below the ambient temperature comprises a pair of oppositely acting rails, said rails in part having a shape commensurate with the shape of the formed joints, said rails being associated with a transport systems that defines a path for stepwise movement of the books.

14. The apparatus of claim 13 wherein said rails define passages for the flow of a coolant and wherein said apparatus further comprises:

means for providing a cold fluid to said rail defined passages to thereby reduce the temperature thereof.

15. The apparatus of claim 11 wherein said means for subjecting the joints to a temperature below ambient temperature includes comprising:

means for directing a cold gas to the vicinity of the book joints.

16. The apparatus of claim 14 wherein said rails include:

means establishing fluid communication between the rail defined passages and the surfaces of the book casing in the region of the joints.

17. The apparatus of claim 12 wherein said transfer elements each include:

a tool having a fluid flow passage extending therethrough; and means establishing fluid communication between said tool passage and the surface of the book casing in the region of the formed joint.

18. The apparatus of claim 14 wherein said fluid providing means supplies a gas at a temperature below 0° C.

19. The apparatus of claim 18 further comprising:

means for directing a cold gas onto the books in the vicinity of the joints.

* * * * *